US005775220A

United States Patent [19]

Thatcher

[11] Patent Number: 5,775,220

[45] Date of Patent: Jul. 7, 1998

[54] METHOD FOR MULTIPLE FRAME SCREEN PRINTING

[76] Inventor: Robert M. Thatcher, 20 Independence Way, Rockaway, N.J. 07866

[21] Appl. No.: 651,382

[22] Filed: May 22, 1996

[51] Int. Cl.[6] ..... B41F 15/36

[52] U.S. Cl. ..... 101/127.1; 101/115; 101/128; 101/128.4

[58] Field of Search ..... 101/115, 126, 101/127, 127.1, 128, 128.1, 128.21, 128.4, 129, 481, 485, 486, DIG. 36

[56] References Cited

U.S. PATENT DOCUMENTS

| | | | |
|---|---|---|---|
| 2,129,163 | 9/1938 | Schneider | 101/115 |
| 2,152,507 | 3/1939 | Trainor | 101/115 |
| 2,613,595 | 10/1952 | Weldon | 101/115 |
| 4,813,351 | 3/1989 | Pierson, Jr. | 101/115 |
| 4,843,963 | 7/1989 | Hoeflein et al. | 101/128 |
| 5,456,174 | 10/1995 | Hung et al. | 101/128.4 |

FOREIGN PATENT DOCUMENTS

| | | | |
|---|---|---|---|
| 89/01870 | 3/1989 | WIPO | 101/115 |

*Primary Examiner*—Stephen R. Funk
*Attorney, Agent, or Firm*—Meroni & Meroni

[57] ABSTRACT

A method for screen printing is provided where multiple screen frames used to facilitate multiple images are carried in fixed registration for an entire screen printing process. The method includes positioning and registering at least two screen frames in fixed registration inside a master frame with the screen frames disposed adjacent to one another and lying in a common plane with the master frame. The steps of coating the screens with emulsion, drying the coated screens, and producing an image on the screens are provided. The master frame is loaded in a printing press and the screens are inked. Printing occurs by repeatably positioning an object in adjacency to each screen for transferring ink through each screen onto the object to produce multiple images on the object where the screens are maintained in fixed registration relative to one another.

14 Claims, 4 Drawing Sheets

METHOD FOR MULTIPLE FRAME SCREEN PRINTING

BACKGROUND OF THE INVENTION

1. Field of the Invention

The present invention relates generally to screen printing. More particularly, the invention pertains to a method of screen printing where multiple screen frames used to facilitate multiple images are carried in registration for the printing of objects, such as T-shirts or signs.

2. Description of the Prior Art

Screen printing is a widely known and used method of printing. The printing of multi-colored images onto articles of clothing, such as T-shirts and jackets, and signs is a common practice.

In general, the screen printing process involves the preparing a fine-mesh screen by coating it with photosensitive emulsion. A photographic image is formed on the emulsion by exposure to bright light causing portions of the emulsion to harden. Unexposed emulsion is then washed away leaving open mesh portions of the screen. The screen is placed in contact with the surface of the object to be printed. Printing ink or dye is transferred through the open mesh portions of the screen and onto the object by drawing a squeegee across the ink or dye covered screen.

When printing a single color or image onto an object, the printing process is relatively straight forward. However, when printing multi-colored images, this process is complicated by the requirement that each screen printing frame be in proper orientation and position relative to the past frames. Improper registration of the successive frames creates a blurred, smeared, or otherwise unacceptable appearance.

Various techniques and methods are known in the art for registering successive frames during printing. Further, many commercially available screen printing devices have been proposed for automating various steps of the screen printing process. However, the high labor factor associated with the handling of multiple screens throughout all the various steps involved in an entire screen printing process has still presented a problem in the industry which results in higher costs, especially in the T-shirt printing industry.

As will be described in greater detail hereinafter, the method of the present invention solves this problem and employs a number of novel features that render it highly advantageous over the prior art.

SUMMARY OF THE INVENTION

Accordingly, it is an object of this invention to provide a method for screen printing where multiple screen frames used to facilitate multiple images are carried in fixed registration for an entire screen printing process.

Another object of this invention is to provide a method of screen printing that reduces labor costs and can utilize existing commercially available equipment with only minor modifications needed.

Still another object of this invention is to provide a screen printing method for creating accurately registered images on articles of clothing, such as T-shirts.

To achieve the foregoing and other objectives, and in accordance with the purposes of the present invention a method for screen printing is provided where multiple screen frames used to facilitate multiple images are carried in fixed registration for an entire screen printing process. The method includes positioning and registering at least two screen frames in fixed registration inside a master frame with the screen frames disposed adjacent to one another and lying in a common plane with the master frame. The steps of coating the screens with emulsion, drying the coated screens, and producing an image on the screens are provided. The master frame is loaded in a printing press and the screens are inked. Printing occurs by repeatably positioning an object in adjacency to each screen for transferring ink through each screen onto the object to produce multiple images on the object where the screens are maintained in fixed registration relative to one another. Independent registering at the printing press is thereby eliminated as well as the independent handling of frames through the entire printing process.

In accordance with an aspect of the invention, the steps of removing the master frame from the printing press and reclaiming and drying the screens while the screens are maintained in registration on the master frame are provided.

Other objects, features and advantages of the invention will become more readily apparent upon reference to the following description when taken in conjunction with the accompanying drawings, which drawings illustrate several embodiments of the invention.

DETAILED DESCRIPTION OF THE PREFERRED EMBODIMENT

Figure 1:
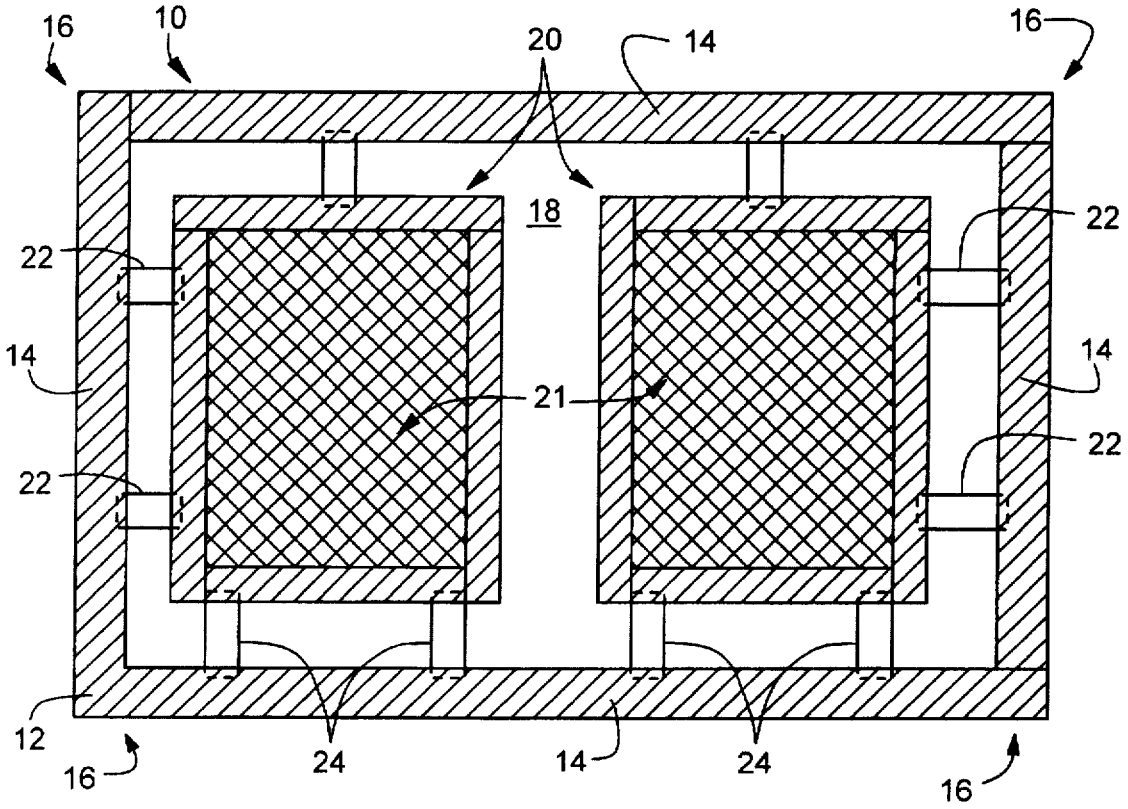
FIG. 1 is a diagrammatic perspective view of a master frame of the present invention.

Referring now to the drawings, a master frame 10 of the present invention is illustrated in FIG. 1. The master frame 10 is preferably formed of a rigid metal material capable of holding its integrity and includes an open rectangular frame 12 having frame members 14 rigidly connected to one another at frame corners 16. The frame defines and bounds a rectangular opening 18 sized and configured for receiving a plurality of screen frames 20. The screen frames 20 are disposed in adjacency to one another and in a common plane with the master frame 10.

Conventional screen frame holding assemblies 22 and registration assemblies 24 which are known in the art are used to place the screen frames in register. Further, the assemblies 22, 24 incorporate the use of mechanical pin assemblies. The pin assemblies have a female member adapted for receiving a male pin member to ensure mechanical alignment. Various pin assemblies are known in the art and are locked in place with various means, such as levers, clamps, or pneumatic systems. The use and application of these assemblies with the present invention is believed to be obvious to one skilled in the art so that further disclosure is not deemed necessary. The use of the pin assemblies in the present invention facilitate the rearrangement of the screen frames 20 in the master frame 10 if the order needs to be rearranged.

It should be noted that the importance with the master frame 10 resides in the fact that it is a common carrier to hold a plurality of screen frames 20 having screens 21 corresponding to multiple images in fixed registration during an entire printing process. For purposes of clarity, it should be understood that the entire printing process is meant to describe those steps that involve the screens 21 once they are in registration with the master frame 10.

While the master frame 10 shown in FIG. 1 illustrates two screen frames, it should be understood that any number of screen frames could be used. For example, four or eight screen frames could be used in a similar fashion to correspond to a four or eight color print. Further, the interface between the screen frames could be made through the use of a micro adjustment bar to facilitate fine register adjustments later in x, y and theta horizontal planes, as well as z axis vertical direction. The use and application of such an adjustment bar should be readily apparent to one skilled in the art.

Figure 2:
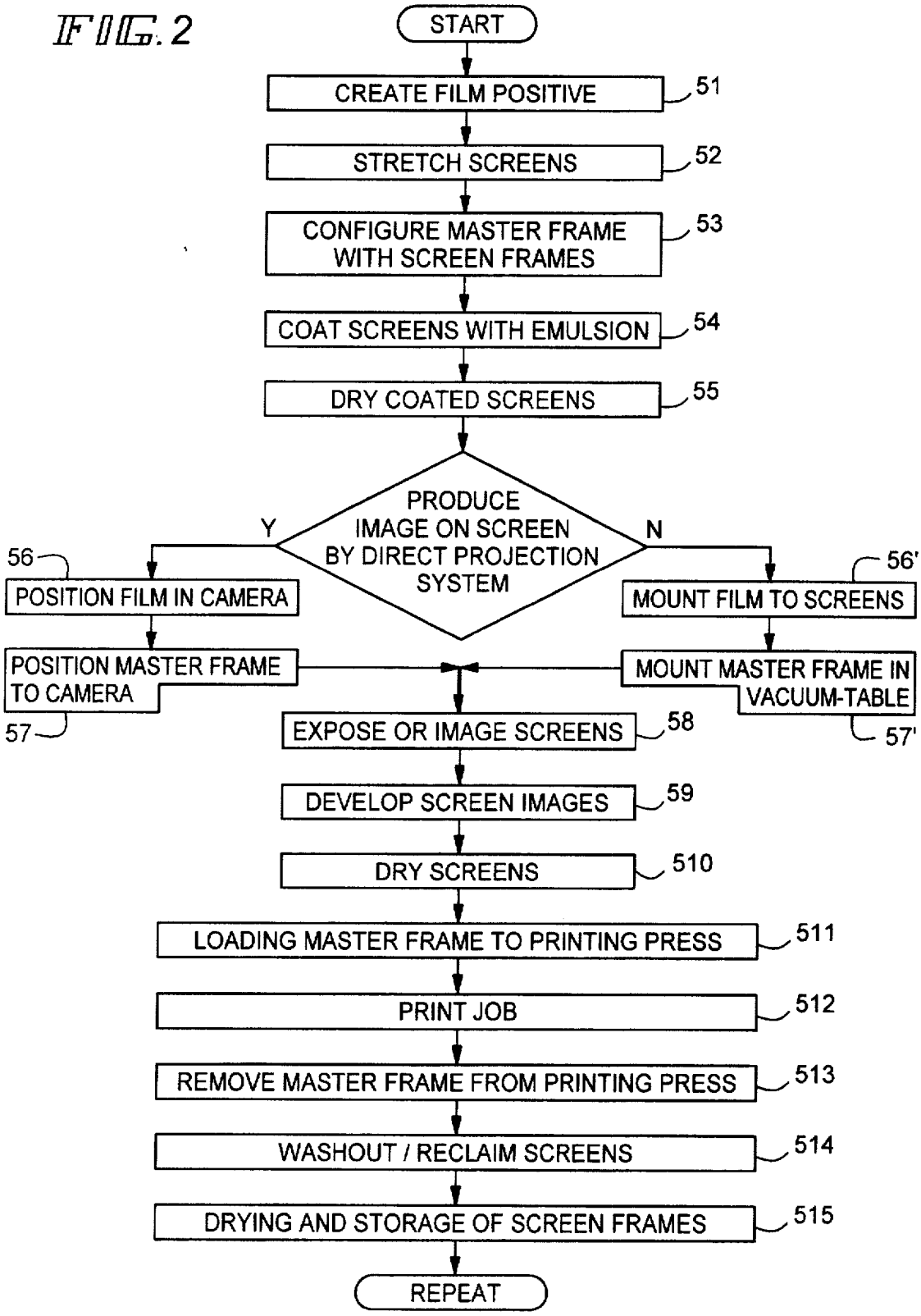
FIG. 2 is a flowchart of the screen printing steps of the present invention.
Figure 3:
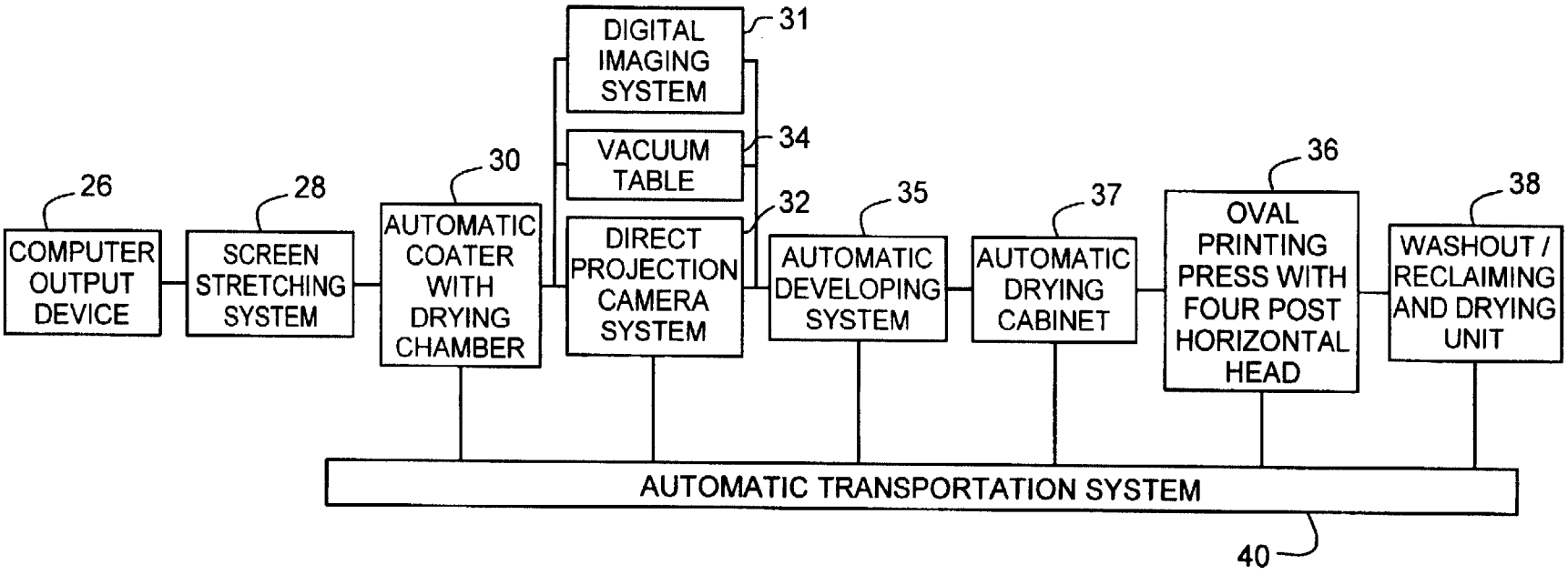
FIG. 3 is a diagrammatic view equipment utilized in several embodiments of the present invention.

Referring to FIGS. 2 and 3, a flowchart is shown to illustrate the general steps in the screen printing process and a diagrammatic view of equipment utilized in several embodiments of the present invention. While the present invention could be applied in the screen printing process for various objects, its textile application is preferred, such as in the screen printing of T-shirts and the like. In the first step, indicated by the numeral S1, after art work is complete, film positives are generated by a computer output device 26 of conventional type. Screens 21 are then stretched at S2 and secured to the screen frames 20. Preferably, this is accomplished on a Harlacher automatic multiple screen stretching system 28 or similar system to insure uniform deflection characteristics under load.

At step S3, the master frame 10 is configured with the screen frames 20 in appropriate sequence on a coarse register system of known type as previously described above. By keeping the frames 20 carried in registration for multiple steps of the printing process, there is a time savings of labor at every following stage based on reduced handling as well as eliminating final registration of images at the printing press. For example, in a T-shirt screening process the manufacturing steps can be sped up over a conventional process so that the required time can be reduced as much as 30% on an average print job with a 52% reduction in labor.

At step S4, the screens 21 are coated with photosensitive emulsion. Conventionally, this step is done manually one screen at a time in textile shops. However, the use of the master frame 10 makes the use of commercially available automatic coaters 30 a preferred option where previously the use of automatic coaters 30 was rarely cost justifiable for textile applications. An auto feeding system can be employed to carry the master frame 10 into a side loaded autocoater, such as the Harlacher automatic screen coater. Only minor modifications would be needed and such modifications would be readily apparent to one skilled in the art.

At step S5, the screens 21 are dried. Conventionally, this is accomplished by placing the screens in a drying cabinet. However, by utilizing the automatic coater 30, as described above, the automatic coater 30 would dry the screens during its operating process by using infrared or jet air or alternatively an inline connected convection drying chamber.

Images are produced on the screens preferably by a direct projection system 32, such as the Direct Projection Camera System SDP by Svecia Screen Printing Systems AB. This system is designed to produce printing screens or frames by exposing them with direct light rather than using traditional acetate films in a vacuum table 32 using a traditional exposure light source. Using this method, all the frames can be loaded simultaneously inline on the master frame 10 from a magazine storage unit instead of one at a time.

The direct projection system 32 is also preferred because it lends itself to be readily placed inline with the coating, drying, storing, exposure, developing, drying, and storing steps, which further automates the process and eliminates the handling of individual frames as known in conventional processes. Another important aspect of using a direct projection system 32 in conjunction with the master frame 10 of the present invention is that all images will be located on the screens within photo-optical tolerances of each other and thereby kept there mechanically through not only the print processes, but right though ink washout and reclaiming and back into the coating process to begin the process all over again. This eliminates image to image registration correction time at the press as well as the need for all of the expensive printing press/equipment technology designed to counter this problem.

If a direct projection system 32 is used, the step S6 of positioning film in the camera and the step S7 of positioning the master frame 10 to the camera will be carried out in accordance with this known system 32. Alternatively, if a direct projection system 32 is not used, the step S6' of mounting film to the screens and the step S7' of mounting the master frame 10 on a vacuum table 34 will be provided. These steps are not significantly altered from conventional use by using the master frame 10 so that further discussion is not believed necessary. It should be understood that other forms of imaging systems could be used, including ink jet technology and digital imaging systems 31 of known design.

Using either a direct projection system 32 or a vacuum table 34, exposure to the screens of step S8 with a UV light source will be accomplished, as previously described. The master frame 10 will be then unloaded from the exposing system of above. At step S9, development of the screen images occurs. Typically, this step is done manually by hand spraying each frame with warm water to expose the image. In the present invention, this step can be done automatically along with step S8 by using the direct projection system 32 which includes an automatic developing system 35. The screen images must then be dried at step S10. An automatic drying cabinet 37, such as the Svecia auto drying cabinet, may be used.

At step S11, loading of the master frame 10 to the printing press 36 is accomplished. In prior art devices, this step is normally done manually where in the present invention, use of the master frame 10 can semi or fully automate this step. Preferably, the printing press 36 is an oval printing press with a four post horizontal head, such as the A.T.P. Automatic Textile Printer by Viprotech B.V. This type of head is common to graphic printing, but is now being used in a unique manner.

The printing press 36 can be equipped with an automatic height adjuster of known design, aligning it with the an empty slot on a frame transport cart and correspondingly raising and lowering accordingly to align it with a new master frame 10. At this time, the master frame 10 would be automatically inserted into the head of the printing press 36 positioned using an automatic frame loading system, such as the Svecia three point automatic screen frame loader. When in place, the master frame 10 is pneumatically locked down. These modifications are considered minor and make use of conventional devices so that further explanation is not deemed necessary. It is significant to note that by utilizing the master frame 10 as previously described, screen frames 20 can be removably interchanged with other screen frames at the press while still maintaining fixed registration.

Figure 4:
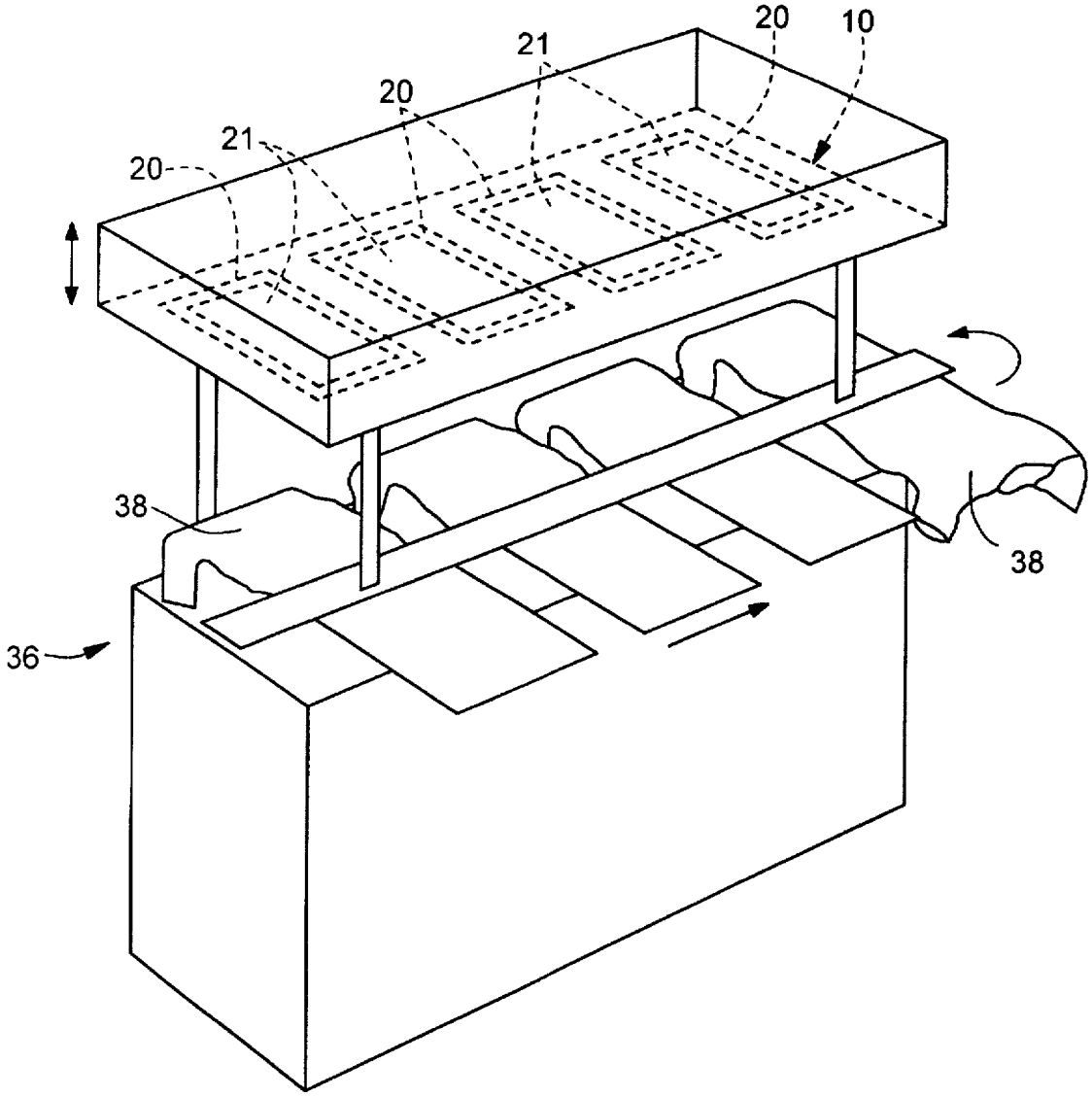
FIG. 4 is a diagrammatic perspective view of an oval style printing press of the present invention.

An oval style printing press 36 is shown diagrammatically in FIG. 4. The master frame 10 is positioned above the press 36 for reciprocating movement to engage the screens against a T-shirt 38. The T-shirts 38 are moved in a linear fashion for engagement with each screen to produce multiple images on the T-shirt 38.

Before printing, the squeegees are generally sharpened. Typically, this process is labor intensive since one squeegee is sharpened at a time. Using the master frame 10, a multihead sharpener can be used to sharpen 4, 8, 12, 14 or more squeegees simultaneously to a mil specification of each other. This is desirable so that all the squeegees are the same length thus further eliminating set up time related to adjusting the squeegee pressure at the press 36. By use of a commercially known fully floating pneumatic squeegee pressure equalizer, adjustment can be nearly eliminated.

The screens are inked and the print job at step S12 is processed by repeatably running the printing press and inking the screens for a desired number of times. It should be understood that various configurations of the master frame 10 with the press 36 could be achieved. For example, two master frames 10 each having 4 screen frames could be used on both sides of a press 36 to create an eight color print. At which point, the master frame 10 is unloaded at step S13. This typically involves removal of the squeegees and flood-bars for cleaning. However, to eliminate squeegee and flood bar removal, the four post oval could have one common head drive for four screens or more that would allow the printing carriage to be raised up and out of the print head over a cleaning trough to wipe the squeegee and flood bar off and place then back onto the print head.

Once the master frame 10 has been unloaded, washout and reclaiming of the screens 21 occurs at step S14. The screens are then dried and stored at step S15, allowing the entire process to be repeated. Preferably, an automatic inline conveyorized washout, reclaiming, and drying unit 38 of conventional type is used. Such units 38 have been designed for commercial use for screen printing of large signs, for example, which then lend themselves to be readily used with the master frame 10 without any particular modifications.

To further automate the present invention, transportation of the master frame 10 can be achieved by the use of an automatic transport system 40, such as the Svecia in line transport system with magazine storage before and after each process step as needed.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. A method for screen printing where multiple screen frames used to facilitate multiple images are carried in fixed registration for an entire screen printing process, the method comprising:

(a) positioning and registering at least two screen frames in fixed registration inside a master frame with the screen frames disposed adjacent to one another and lying in a common plane with the master frame, each screen frame having a screen;

(b) coating the screens with emulsion;

(c) drying the coated screens;

(d) producing an image on the screens;

(e) loading the master frame in a printing press;

(f) inking the screens; and (g) printing by repeatably positioning an object in adjacency to each screen for transferring ink through each screen onto the object to produce multiple images on the object where the screens are maintained in fixed registration relative to one another.

2. The method of claim 1, further comprising the step of removing the master frame from the printing press and reclaiming and drying the screens while the screens are maintained in registration on the master frame.

3. The method of claim 1, wherein the printing press is an oval type textile printing press having a horizontal four post head for moving the object in a linear movement for printing with each adjacent screen.

4. The method of claim 1, wherein the step of producing an image on the screens includes the steps of positioning a film in a direct projection system camera, positioning the master frame to the camera, and exposing and developing the screens.

5. The method of claim 1, wherein the step of producing an image on the screens includes the steps of mounting a film to the screens, mounting the master frame in a vacuum table, and exposing and developing the screens.

6. A method for screen printing where multiple screen frames used to facilitate multiple images are carried in fixed registration for an entire screen printing process, the method comprising:

(a) positioning and registering at least two screen frames in fixed registration inside a master frame with the screen frames disposed adjacent to one another and lying in a common plane with the master frame, each screen frame having a screen;

(b) coating the screens with emulsion;

(c) drying the coated screens;

(d) producing an image on the screens;

(e) loading the master frame in a printing press;

(f) inking the screens;

(g) printing by repeatably positioning an object in adjacency to each screen for transferring ink through each screen onto the object to produce multiple images on the object where the screens are maintained in fixed registration relative to one another; and (h) removing the master frame from the printing press and reclaiming and drying the screens while the screens are maintained in registration on the master frame.

7. The method of claim 6, wherein the printing press is an oval type textile printing press having a horizontal four post head for moving the object in a linear movement for printing with each adjacent screen.

8. The method of claim 6, wherein the step of producing an image on the screens includes the steps of positioning a film in a direct projection system camera, positioning the master frame to the camera, and exposing and developing the screens.

9. The method of claim 6, wherein the step of producing an image on the screens includes the steps of mounting a film to the screens, mounting the master frame in a vacuum table, and exposing and developing the screens.

10. The method of claim 6, wherein each screen frame has pin-assembly means so that the screens are removably interchangeable with one another at the printing step while maintaining the screens in fixed registration.

11. A method for screen printing on T-shirts where multiple screen frames used to facilitate multiple images are carried in fixed registration in a master frame for an entire screen printing process, the method comprising:

(a) positioning and registering at least two screen frames in fixed registration inside a rectangular master frame with the screen frames disposed linearly adjacent to one another and lying in a common plane with the master frame, each screen frame having screen;

(b) automatically coating the screens with emulsion;

(c) drying the coated screens;

(d) producing an image on the screens;

(e) loading the master frame on an oval type textile printing press having a horizontal four post head for moving a T-shirt in a linear movement for aligned positioning with each adjacent screen;

(f) inking the screens;

(g) printing by repeatably positioning the T-shirt in adjacency to each screen as the object moves in a linear fashion on the press for transferring ink through each screen onto the T-shirt to produce multiple images on the T-shirt where the screens are maintained in fixed registration relative to one another; and (h) removing the master frame from the printing press and reclaiming and drying the screens while the screens are maintained in registration on the master frame.

12. The method of claim 11, wherein the step of producing an image on the screens includes the steps of positioning a film in a direct projection system camera, positioning the master frame to the camera, and exposing and developing the screens.

13. The method of claim 11, wherein the step of producing an image on the screens includes the steps of mounting a film to the screens, mounting the master frame in a vacuum table, and exposing and developing the screens.

14. The method of claim 11, wherein each screen frame has pin-assembly means so that the screens are removably interchangeable with one another at the printing step while maintaining the screens in fixed registration.

* * * * *